US005137084A

United States Patent [19]

Gonzales et al.

[11] Patent Number: 5,137,084

[45] Date of Patent: Aug. 11, 1992

[54] ROTATING HEAD

[75] Inventors: Don E. Gonzales, Cordell, Okla.; Robert M. Bearden, Fort Smith, Ark.

[73] Assignee: The Sydco System, Inc., Cordell, Okla.

[21] Appl. No.: 630,926

[22] Filed: Dec. 20, 1990

[51] Int. Cl.[5] ..... E21B 33/00

[52] U.S. Cl. ..... 166/84; 175/195; 175/209; 277/3; 277/31; 285/16

[58] Field of Search ..... 166/82, 84; 175/195, 175/209; 277/3, 31; 285/16

[56] References Cited

U.S. PATENT DOCUMENTS

| | | | |
|---|---|---|---|
| 3,052,300 | 9/1962 | Hampton | 166/84 |
| 3,400,938 | 9/1968 | Williams | 277/31 |
| 3,724,862 | 4/1973 | Biffle | 277/31 |
| 3,965,987 | 6/1976 | Biffle | 277/31 X |
| 4,293,047 | 10/1981 | Young | 175/195 |
| 4,345,769 | 8/1982 | Johnston | 175/195 X |
| 4,363,357 | 12/1982 | Hunter | 166/84 |
| 4,423,776 | 1/1984 | Wagoner et al. | 166/84 |
| 4,480,843 | 11/1984 | Springer | 277/31 |
| 4,486,025 | 12/1984 | Johnston | 175/195 X |
| 4,526,243 | 7/1985 | Young | 175/195 |
| 4,531,591 | 7/1985 | Johnston | 175/57 |
| 4,560,001 | 12/1985 | Gonzales | 166/84 |
| 4,745,970 | 5/1988 | Bearden et al. | 166/84 |

OTHER PUBLICATIONS

Pruitt Rotating Heads—Sales Brochure, 8 pages.
Williams Tool Co., Inc.—Sales Brochure, 5 pages.
Fugett Equipment Co.—Ad Sheet—1 page.
Exhibit A—Sketch, Undated, Entitiled "Adams Head".
Exhibit B—Drawing "B" Adams Rotating Head Without Drive . . .
Exhibit C—Drawing "A" Head Rubber With Drive Built Into . . .
Exhibit D—Grant Oil Tool Co. Sales Brochure—Grant Rotating . . .

*Primary Examiner*—Ramon S. Britts
*Assistant Examiner*—Roger J. Schoeppel

[57] ABSTRACT

A rotating head having a bowl assembly and a rotating assembly disposed in a bowl opening formed in the bowl assembly. The rotating assembly comprises and elastomeric member and a rotating bushing. The rotating bushing is connected to an outer peripheral surface of the elastomeric member. The rotating bushing bearingly contacts a portion of the bowl assembly during the operation of the rotating head wherein the elastomeric member and the rotating bushing are rotated and the elastomeric member sealingly engages a portion of the bowl assembly for forming a seal between the rotating assembly and the bowl assembly. The rotating assembly is removable from the bowl assembly and can be replaced with another rotating assembly thereby simultaneously replacing the elastomeric member and the rotating bushing.

23 Claims, 4 Drawing Sheets

ROTATING HEAD

FIELD OF THE INVENTION

The present invention generally relates to rotating heads and, more particularly, but not by way of limitation, to a rotating head with a rotating assembly comprising of an elastomeric member and a rotating bushing which are removable and replaceable as a unit.

BRIEF DESCRIPTION OF THE DRAWINGS

FIG. 6 is a top plan view of the rotating head with the upper housing plate removed.

DESCRIPTION OF THE PREFERRED EMBODIMENTS

Figure 1:
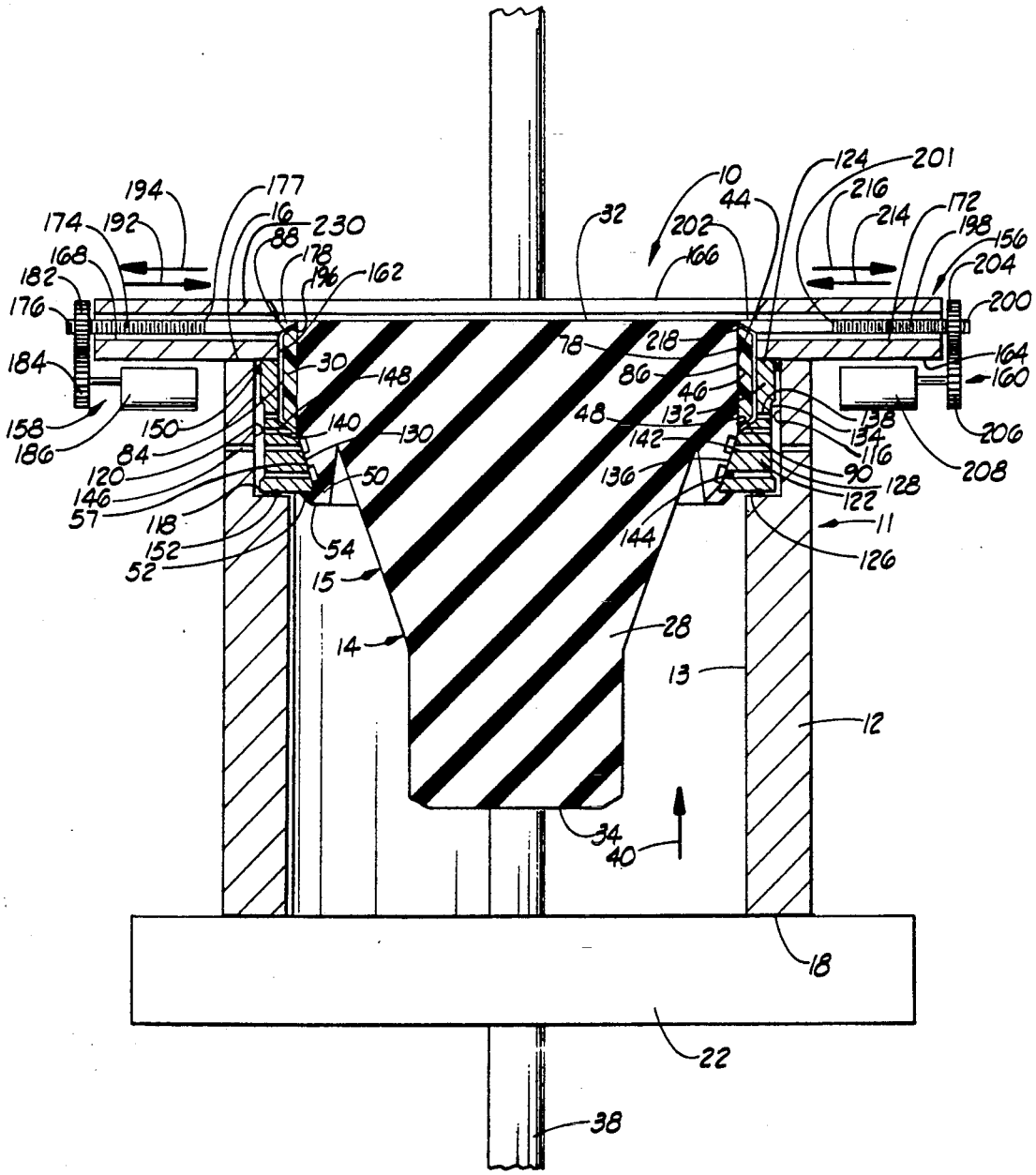
FIG. 1 is a sectional view of a rotating head constructed in accordance with the present invention.
Figure 2:
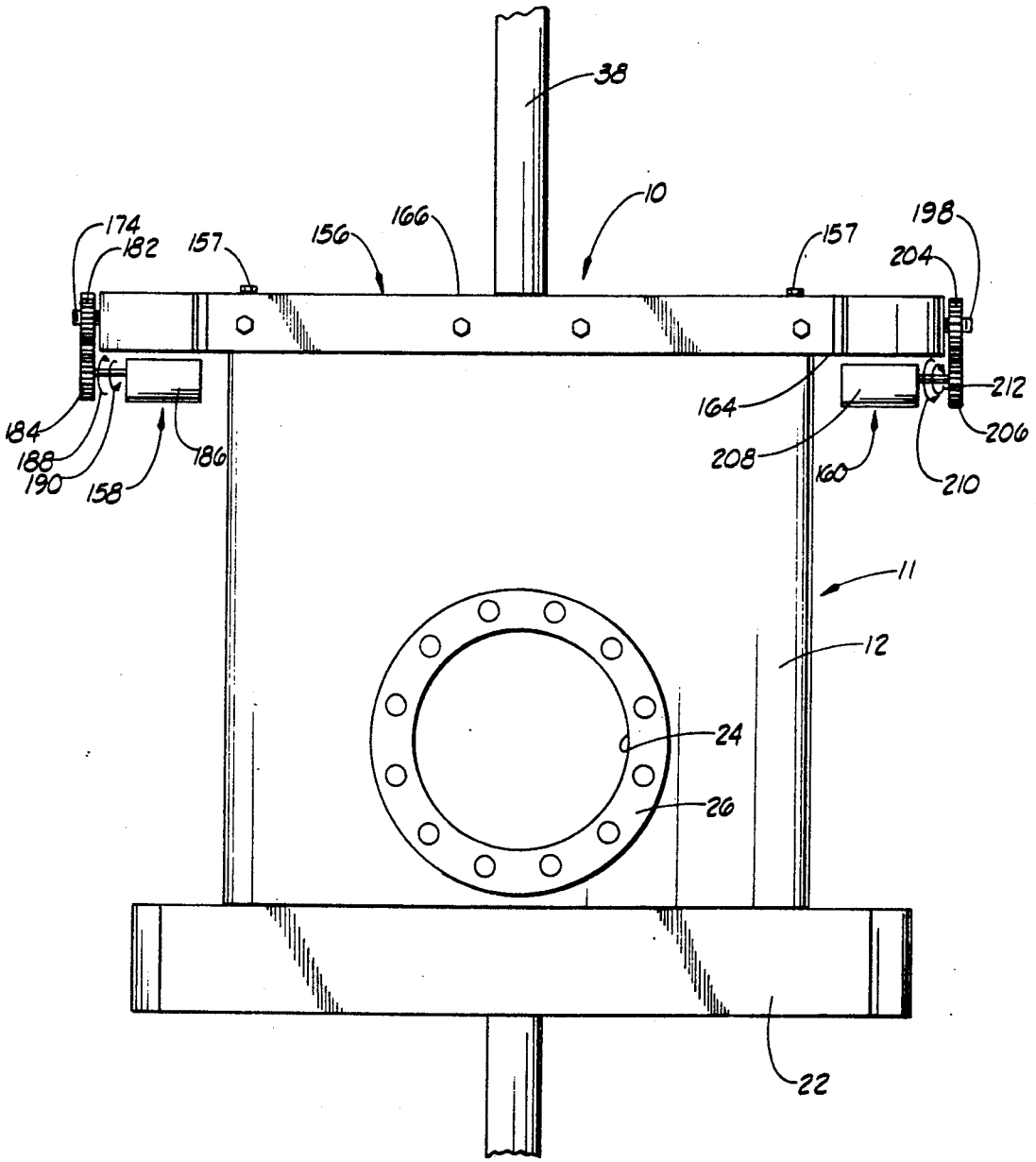
FIG. 2 is a side elevational view of the rotating head of FIG. 1.

Shown in FIGS. 1 and 2 is a rotating head 10 which is constructed in accordance with the present invention. The rotating head 10 basically comprises a bowl assembly 11 having a bowl opening 13 (FIG. 1) formed therein and a rotating assembly 14 (FIG. 1) having an elastomeric member outer peripheral surface 15 (FIG. 1) disposed in the bowl opening 13. The rotating assembly 14 is rotatingly disposed in the bowl opening 13 and portions of the rotating assembly 14 sealingly engage portions of the bowl assembly 11 and other portions of the rotating assembly 14 bearingly engage portions of the bowl assembly 11 during the rotation of the rotating assembly 14 in the bowl assembly 11.

As shown in FIGS. 1 and 2, the bowl assembly 11 comprises an outer bowl 12 having an upper end 16, a lower end 18. The bowl opening 13 more particularly extends through the outer bowl 12 intersecting the upper end 16 and the lower end 18 of the outer bowl 12.

A connecting flange 22 (FIGS. 1 and 2) is formed on the lower end 18 of the outer bowl 12. The connecting flange 22 extends a distance radially from outer bowl 12.

A discharge opening 24 (FIG. 2) is formed through the outer bowl 12 and positioned generally between the upper end 16 and the lower end 18 of the outer bowl 12. The discharge opening 24 intersects the bowl opening 13. A discharge flange 26 (FIG. 2) is formed on the outer bowl 12 encompassing the discharge opening 24.

Figure 3:
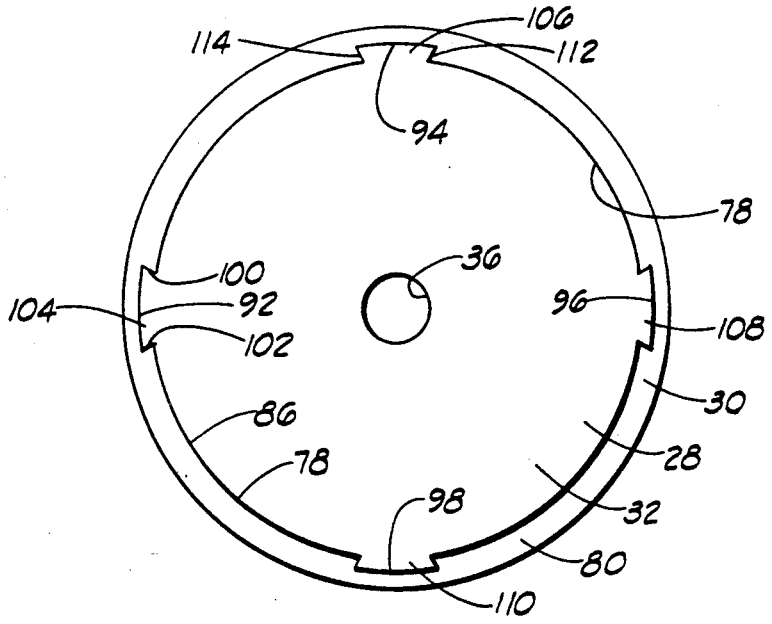
FIG. 3 is a top elevational view of the rotating assembly used in the rotating head of FIGS. 1 and 2.
Figure 4:
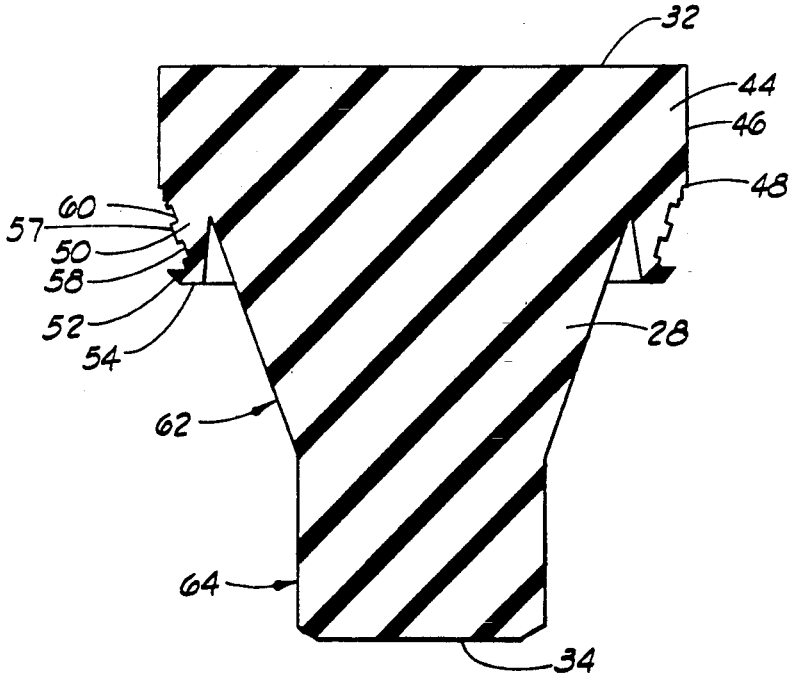
FIG. 4 is a side elevational view of the elastomeric member portion of the rotating assembly.
Figure 5:
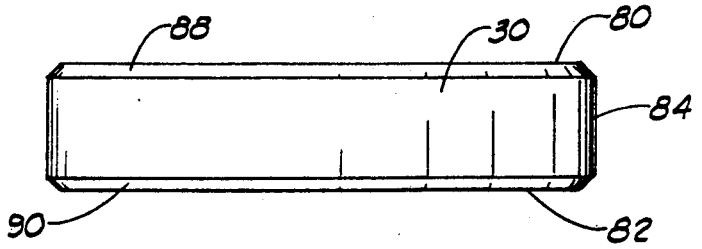
FIG. 5 is a side elevational view of the rotating bushing portion of the elastomeric member.
Figure 8:
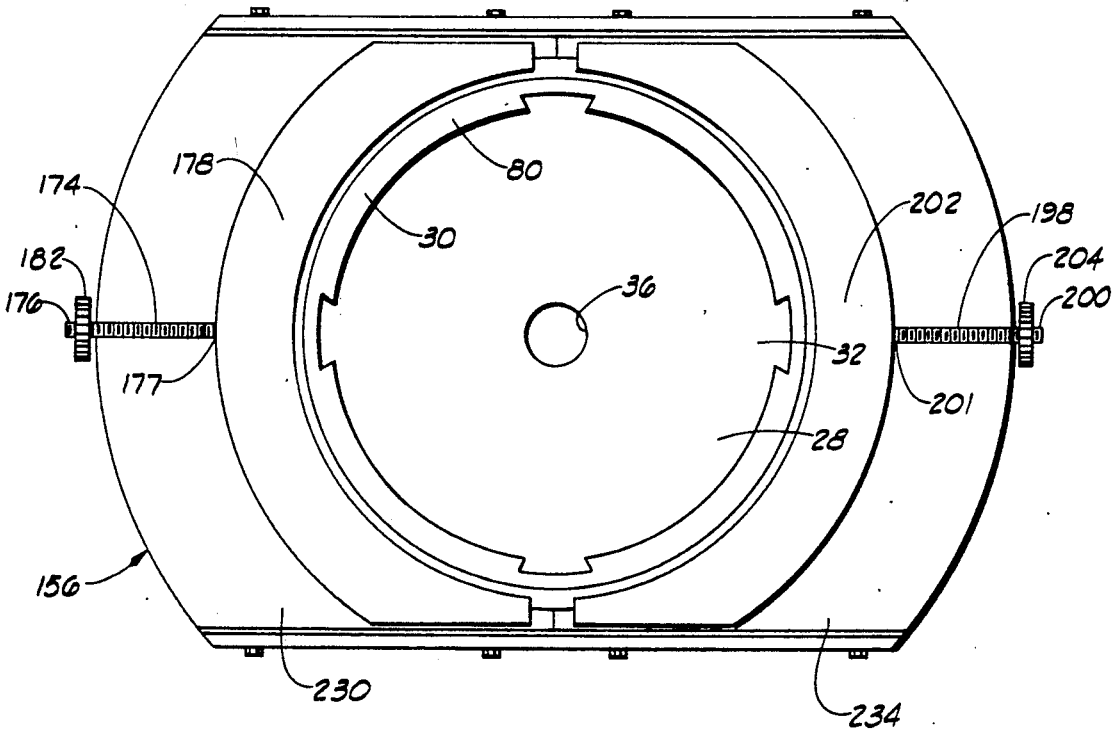

The rotating assembly 14 comprises an elastomeric member 28 (FIGS. 1, 3 and 4) and a rotating bushing 30 (FIGS. 1, 3 and 5). The rotating bushing 30 is connected to the elastomeric member 28.

As shown in FIGS. 1, 3 and 4, the elastomeric member 28 has an upper end 32 and a lower end 34. A circularly shaped drive opening 36 (FIG. 3) is formed through the elastomeric member 28 intersecting the upper and the lower ends 32 and 34 thereof. The drive opening 36 is sized and shaped to receive a kelly or drill pipe 38 (FIGS. 1 and 2). The drill pipe 38 has a circularly shaped cross section and the drive opening 36 is slightly small than the diameter of the drill pipe 38 so that, when the drill pipe 38 is extended through the drive opening 36 a sealing and gripping engagement is formed between the elastomeric member 28 and the drill pipe 38.

It should be noted that the drill pipe 38 may have a square or multi-sided cross-section in some instances. In this event, the diameter of the drive opening 36 is smaller than the effective diameter of the drill pipe 38 so that the sealing and gripping engagement between the elastomeric member 28 and the drill pipe 38 still is formed.

During the drilling operations at an oil well, gas well or oil and gas well drilling site (well drilling site), a drill pipe or kelly 38 is extended into the well bore (not shown in the drawings) and drilling fluid is passed into the borehole. A plurality of blowout preventers (not shown in the drawings) are connected to the well bore-hole and the rotating head 10 is connected to the upper most blow-out preventer via the connecting flange 22. The drill pipe 38 extends through the rotating head 10 and through the blow-out preventers and into the well bore hole. During the drilling operations, drilling fluid is passed from the well bore-hole, up through the blow-out preventers and up through the bowl opening 13 in a direction 40 (FIG. 1). The rotating head 10 is designed to divert the received drilling fluid out through the discharge opening 24 in a direction generally perpendicular to the direction 40 for passing the drilling fluid back to a fluid pit or pits (not shown) located at the well drilling site generally near the drilling operations. The drilling fluid commonly is referred to in the industry as drilling mud. The drill pipe 38 is rotated during the drilling operations. The elastomeric member 28 sealingly engages the drill pipe 38 to prevent the drilling fluid from being passed upwardly in the direction 40 through the rotating head 10 and on to the drilling platform floor or onto another portion of the drilling rig. The rotating head functions to divert the received drilling fluid for passing the drilling fluid back to the mud pit or pits.

As the drill pipe 38 is rotated during the drilling operations, the rotation of the drill pipe 38 rotates the rotating assembly 14 due to the sealing and gripping engagement between the elastomeric member 28 and the drill pipe 38. As the rotating assembly 14 is rotated, the rotating bushing 30 bearingly engages a portion of the bowl assembly 11 for bearingly supporting the rotating assembly 14 in the bowl opening 13. It is significant to note that the rotating bushing 30 provides the only bearing support for the rotating assembly 14 and that the rotating bushing 30 is integrally constructed with and connected to the elastomeric member 28. Thus, when it becomes necessary to replace the rotating assembly 14 due to wear, the rotating assembly 14 comprising the elastomeric member 28 and the rotating bushing 30 can be removed from the outer bowl 12 and then replaced as a unit thereby replacing the sealing and bearing portions of the rotating assembly simultaneously and without the need for replacing separately located bearing members.

A portion 44 (FIGS. 1 and 4) of the elastomeric member 28 is generally cylindrically shaped forming a flat, substantially vertically extending outer peripheral surface 46 (FIGS. 1 and 4). The cylindrically shaped portion 44 has an upper end corresponding to the upper end 32. The cylindrically shaped portion 44 extends from the upper end 32 of the elastomeric member 28 a distance generally toward the lower end 34 terminating with a lower end 48 (FIGS. 1 and 4) of the cylindrically shaped portion 44.

A sealing flange 50 (FIGS. 1 and 4) extends from the lower end 48 of the cylindrically shaped portion 44 a distance at an angle tapered inwardly toward the drive opening 36 of the elastomeric member 28.

A lip 52 (FIGS. 1 and 4) is formed on a lower end 54 (FIGS. 1 and 4) of the sealing flange 50. The lip 52 extends radially outwardly from the sealing flange 50.

The tapered inwardly portion of the sealing flange 50 provides an outer peripheral surface 57 (FIGS. 1 and 4). A pair of grooves 58 (FIG. 4) and 60 (FIG. 4) are formed in an outer peripheral surface 57 of the sealing flange 50 and each of the grooves 58 and 60 extends circumferentially about the sealing flange 50.

A portion 62 (FIG. 4) of the elastomeric member 28 extends from about the sealing flange 50 toward the lower end 18 of the elastomeric member 28 and this portion 62 is tapered inwardly generally toward the drive opening 36. The portion 62 tapers inwardly toward the drive opening 36 terminating with a cylindrically shaped portion 64 (FIG. 4) which extends from the tapered portion 62 to the lower end 18 of the elastomeric member 28.

As shown in FIG. 5, the rotating bushing 30 has an upper end 80 and a lower end 82. The rotating bushing 30 has an outer peripheral surface 84 (FIGS. 1 and 5) and an inner peripheral surface 86 (FIG. 1) forming a bushing opening 78 (FIGS. 1 and 3) which extends through the rotating bushing 30 intersecting the upper end 80 and the lower end 82.

An upper tapered wall 88 (FIGS. 1 and 5) is formed on the upper end 80 of the rotating bushing 30 and the upper tapered wall 88 extends generally between the outer peripheral surface 84 and the inner peripheral surface 86 forming an upper bearing surface (sometimes referred to herein as the upper bearing surface 88). A lower tapered wall 90 (FIGS. 1 and 5) is formed on the lower end 82 of the rotating bushing 30. The lower tapered wall 90 extends generally between the outer peripheral surface 84 and the inner peripheral surface 86 forming a lower bearing surface (sometimes referred to herein as the lower bearing surface 90).

The upper end 32 of the elastomeric member 28 is disposed through the bushing opening 78 to a position wherein the cylindrically shaped portion 44 is disposed within the bushing opening 78. The cylindrically shaped portion 44 is sized so that the lower end 82 of the rotating bushing 30 is disposed generally adjacent the lower end 48 of the cylindrically shaped portion 44 and the upper end 80 of the rotating bushing 30 is disposed generally adjacent the upper end 32. In this position, the inner peripheral surface 86 of the rotating bushing 30 is connected to the outer peripheral surface 46 of the cylindrically shaped portion 44 such as by an adhesive. The rotating bushing 30 and the elastomeric member 28 are connected to form an integral rotating assembly 14.

The outer peripheral surface 84 of the rotating bushing 30, the outer peripheral surface 57 and the outer peripheral surfaces formed by the portions 62 and 64 comprise the elastomeric member outer peripheral surface 15 of the rotating assembly 14.

As shown in FIG. 3, four recesses 92, 94, 96 and 98 are formed in the inner peripheral surface 86 of the rotating bushing 30. The recesses 92, 94, 96 and 98 are spaced circumferentially about the inner peripheral surface 86 with the recesses 92, 94, 96 and 98 being spaced about 90° apart. Each of the recesses 92, 94, 96 and 98 are identical in construction and each includes a pair of tapered walls 100 and 102 (the tapered walls 100 and 102 being shown in FIG. 3 only with respect to the recess 92). The tapered walls 100 and 102 each are tapered outwardly from the inner peripheral surface 86 toward the outer peripheral surface 84 of the rotating bushing 30.

As shown in FIG. 3, four recess flanges 104, 106, 108 and 110 are formed on the outer peripheral surface 46 of the cylindrically shaped portion 44. Each of the recess flanges 104, 106, 108 and 110 extends a distance outwardly from the outer peripheral surface 46. The recess flanges 104, 106, 108 and 110 are spaced circumferentially about the outer peripheral surface 46 with the recess flanges 104, 106, 108 and 110 being spaced about 90° apart. Each of the recess flanges 104, 106, 108 and 110 includes a pair of tapered walls 112 and 114 (only the tapered walls 112 and 114 being shown in FIG. 3 with respect to the recessed flange 106). The tapered walls 112 and 114 each are tapered outwardly from the outer peripheral surface 46 of the cylindrically shaped portion 44. Each recess flange 104, 106, 108 and 110 extend a distance outwardly from the outer peripheral surface 46 of the cylindrically shaped portion 44.

Each recess flange 104, 106, 108 and 110 is sized and shaped to matingly fit within one of the recesses 92, 94, 96 and 98 in the rotating bushing 30 in an assembled position of the rotating bushing 30 in the elastomeric member 28.

A circularly shaped recess 116 (FIG. 1) is formed in the upper end 32 of the outer bowl 12. The recess 116 extends a distance through the outer bowl 12 toward the lower end 34 of the outer bowl 12 terminating with a lower edge 118 (FIG. 1) and forming an inner peripheral surface 120 (FIG. 1).

A wear insert 122 (FIG. 1) is disposed generally within the recess 116. The wear insert 122 is cylindrically shaped. The wear insert 122 has an upper end 124 (FIG. 1), a lower end 126 (FIG. 1), an outer peripheral surface 128 (FIG. 1) and an inner peripheral surface 130 (FIG. 1). A portion 132 (FIG. 1) of the inner peripheral surface 130 is vertically oriented and extends from the upper end 124 a distance generally toward the lower end 126 terminating with a lower end 134 (FIG. 1) of the portion 132. The inner peripheral surface 130 also includes a tapered portion 136 (FIG. 1) which extends from the lower end 134 of the portion 132 at an angle inwardly terminating with the lower end 126 of the wear insert 122.

As shown in FIG. 1, four openings 138, 140, 142 and 144 are formed through the wear insert 122 with each of the openings 138, 140, 142 and 144 extending through the wear insert 122 intersecting the outer and the inner peripheral surfaces 128 and 130. The of the openings 140, 142 and 144 more particularly intersect the tapered portion 136 and the other opening 138 intersects the portion 132. An opening 146 (FIG. 1) is formed through the outer bowl 12 and the opening 146 intersects the outer peripheral surface of the outer bowl 12 and the inner peripheral surface 120 formed by the recess 116.

A bearing surface 148 (FIG. 1) is formed on the inner peripheral surface (130) of the wear insert 122. The bearing surface 148 is angled outwardly and downwardly with respect to the outer peripheral surface 128. The bearing surface 148 bearingly engages the lower bearing surface 90 on the rotating bushing 30.

An upper O-ring seal member 150 (FIG. 1) is disposed between the outer peripheral surface 128 of the wear insert 122 generally near the upper end 124 of the wear insert 122 and the inner peripheral surface 120 formed by the recess 116 in the outer bowl 12. A lower O-ring seal member 152 (FIG. 1) is disposed between the lower end 126 of the wear insert 122 and the lower edge 118 formed by the recess 116 in the outer bowl 12. The O-rings 150 and 152 form seals between the wear insert 122 and the outer bowl 12 sealing off a lubricant space. In operation, lubricant (grease) is inserted through the opening 146 and into the lubricant space. The lubricant in the lubricant space flows through the openings 138, 140, 142 and 144 for providing lubricant between the elastomeric member 28 and the wear insert 122 and between the rotating bushing 30 and the wear insert 122.

As shown in FIGS. 1 and 2, a cylindrically shaped clamp housing 156 is secured to the upper end 32 of the outer bowl 12. Portions of the clamp housing 156 extend a distance radially outwardly from the outer peripheral surface of the outer bowl 12. The clamp housing 156 is secured to the upper end 16 of the outer bowl 12 via a plurality of bolts 157 (only some of the bolts 157 being shown in the FIG. 2).

As shown in FIGS. 1 and 2, the rotating head 10 includes a pair of clamp means 158 and 160. The clamp means 158 and 160 are disposed generally on opposite sides of the outer bowl 12 about a 180° apart. The clamp means 158 and 160 are identical in construction and operation.

A circularly shaped recess 162 (FIG. 1) is formed through a lower surface 164 (FIGS. 1 and 2) of the clamp housing 156. The recess 162 extends a distance from the lower surface 164 toward an upper surface 166 (FIGS. 1 and 2). The recess 162 has a diameter slightly larger than the diameter of the cylindrically shaped portion 44 of the elastomeric member 28. A portion of the cylindrically shaped portion 44 of the elastomeric member 28 is disposed in the recess 162 in the clamp housing 156.

A first clamp screw opening 168 (FIG. 1) is formed through the clamp housing 156 with the first clamp screw opening 168 intersecting an outer peripheral surface of the clamp housing 156. The first clamp screw opening 168 extends through the clamp housing 156 and intersects the recess 162.

A second clamp screw opening 172 (FIG. 1) is formed through the clamp housing 156. The second clamp screw opening 172 intersects the outer peripheral surface of the clamp housing 156. The second clamp screw opening 172 extends through the clamp housing 156 and intersects the recess 162. The first clamp screw opening 168 is spaced about 180° from the second clamp screw opening 172.

As shown in FIGS. 1 and 6, a first threaded rod 174 is disposed in the first clamp screw opening 168. The first threaded rod 174 has a first end 176 and a second end 177. The first end 176 of the first threaded rod 174 extends through a threaded opening formed through a central portion of a first gear 182 (FIGS. 1 and 2). The first threaded rod 174 thus is threadedly connected to the first gear 182. The first gear 182 meshingly engages a second gear 184 (FIGS. 1 and 2). The second gear 184 is connected to a hydraulic motor 186 (FIGS. 1 and 2). The hydraulic motor 186 is connected to a pressurized hydraulic supply (not shown) with appropriate controls for conditioning the motor 186 in a driving condition and in an off condition. In the driving condition, the hydraulic motor 186 can be driven in a first rotating direction 188 (FIG. 2) or an opposite second rotating direction 190 (FIG. 2).

When the hydraulic motor 186 is driven in the first rotating direction 188, the second gear 184 is rotated in the first rotating direction 188 thereby causing the first gear 182 to be rotated in the opposite direction for driving the first threaded rod 174 in a direction 192 (FIG. 1) generally toward the rotating assembly 14. By the same token, when the hydraulic motor 186 is actuated to rotate the second gear 184 and the second rotating direction 190, the first gear 182 is rotated in the first rotating direction 188 thereby causing the first threaded rod 174 to be moved in a direction 194 (FIG. 1) generally away from the rotating assembly 14.

A semi-circular bearing plate 178 (FIGS. 1 and 6) is connected to the second end 177 of the first threaded rod 174. An angled edge 196 (FIG. 1) is formed on the bearing plate 178. The angled edge 196 forms a bearing surface 196 is shaped and positioned to bearingly engage a portion of the upper bearing surface 100 formed on the upper end 80 of the rotating bushing 30.

A second threaded rod 198 (FIGS. 1 and 6) is disposed in the second clamp screw opening 172. The second threaded rod 198 has a first end 200 and a second end 201 (FIGS. 1 and 6). The first end 200 of the second threaded rod 198 extends through a threaded opening formed through a central portion of a first gear 204 (FIGS. 1 and 2). The second threaded rod 198 thus is threadedly connected to the first gear 204. The first gear 204 meshingly engages a second gear 206 (FIGS. 1 and 2). The second gear 206 is connected to a hydraulic motor 208 (FIGS. 1 and 2). The hydraulic motor 208 is connected to a pressurized hydraulic supply (not shown) with appropriate controls for conditioning the motor 208 in a driving condition and in an off condition. In the driving condition, the hydraulic motor 208 can be driven in a first rotating direction 210 (FIG. 2) or a second rotating direction 212 (FIG. 2).

When the hydraulic motor 208 is driven in the first rotating direction 210, the second gear 206 is rotated in the first rotating direction 210 thereby causing the first gear 204 to be rotated in the opposite direction for driving the second threaded rod 198 in a direction 214 (FIG. 1) generally toward the rotating assembly 14. By the same token, when the hydraulic motor 208 is actuated to rotate the second gear 206 and the second rotating direction 212, the first gear 204 is rotated in the first rotating direction 210 thereby causing the second threaded rod 198 to be moved in a direction 216 (FIG. 1) generally away from the rotating assembly 14.

A semi-circular bearing plate 202 (FIGS. 1 and 6) is connected to the second end 201 of the second threaded rod 198. An angled edge 218 (FIG. 1) is formed on the second end 202 of the second threaded rod 198. The angled edge 218 forms a bearing surface and is shaped and positioned to bearingly engage a portion of the upper bearing surface 100 formed on the upper end 80 of the rotating bushing 30.

The clamp housing 156 more particularly comprises an upper housing plate 230 (FIGS. 1 and 6) and a pair of lower housing plate 232 and 234 (FIG. 6).

The clamp housing 156 is removed from the outer bowl 12. Then, the rotating assembly 14 is disposed in the bowl opening 13 to a position wherein the lower bearing surface 90 on the rotating bushing 30 engages the bearing surface 148 formed on the wear insert 122. In this position, the tapered portion 62 on the sealing flange 50 sealingly engages the tapered portion 136 on the wear insert 122 and the lip 52 engages the lower end 126 of the wear insert 122.

The clamp housing 156 then is connected to the upper end 16 of the outer bowl 12. The first and the second threaded rods 174 and 198 initially are positioned so that the first ad the second threaded rods 174 and 198 have been moved in the respective directions 194 and 216 to a position wherein the bearing surfaces 196 and 218 on the respective clamp plates 178 and 202 each are spaced a distance from the recess 162. After the clamp housing 156 has been secured to the upper end 16 of the outer bowl 12, the motors 186 and 208 are actuated to rotatingly drive the first and the second threaded rods 174 and 198 in the respective directions 192 and 214 to a position wherein the bearing surface 196 on the bearing plate 178 engages the upper bearing surface 100 on the rotating bushing 30 and the bearing surface 218 on the bearing plate 202 engages a portion of the upper bearing surface 100 on the rotating bushing 30. The rotating assembly 14 is bearingly supported in the outer bowl 12 via the upper and the lower bearing surfaces 100 and 102 formed on the rotating bushing 30 and the bearing surface 148 formed on the wear insert 122 and the bearing surfaces 196 and 218 on the first and the second threaded rods 174 and 198. As the bearing surfaces 88, 90, 196, 218 and 148 wear, the first and the second threaded rods 174 and 198 can be adjusted inwardly and outwardly to provide the proper bearing engagement.

When the drill pipe 38 is drivingly rotated, the elastomeric member 28 and the rotating bushing 30 connected thereto each are drivingly rotated due to the gripping engagement between the elastomeric member 28 and the drill pipe 38. As the rotating assembly 14 rotates, the portion 62 of the sealing flange 50 sealing engages the tapered portion 136 on the wear insert 122 and the lip 52 sealingly engages the lower end 126 of the wear insert 122 for providing sealing engagement between the rotating assembly 14 and the outer bowl 12.

If the rotating bushing 30 or the elastomeric member 28 becomes worn or otherwise in need of repair or replacement, the clamp housing 156 is unbolted and removed from the outer bowl 12. In this position of the clamp housing 156, the rotating assembly 14 including both the elastomeric member 28 and the rotating bushing 30 connected thereto are removed from the bowl opening 13. After removal of the rotating assembly 14, a new or repaired rotating assembly 14 then can be installed in the bowl opening 13 and the clamp housing 156 then can be reassembled to the outer bowl 12. The replacement of the rotating assembly 14 replaces the bearing and the sealing members.

Changes may be made in the construction and the operation of the various components, elements and assemblies described herein without departing from the spirit and scope of the invention as defined in the following claims.

What is claimed is:

1. A rotating head adapted for use in drilling a well borehole at a well drilling cite wherein drilling fluid is passed into the well borehole and wherein some of the drilling fluid is passed from the well borehole and wherein a rotatable drill pipe extends into the well borehole during the drilling operation, comprising:

a bowl assembly having a bowl opening and a discharge opening, the bowl assembly being adapted to receive drilling fluid into the bowl opening and pass the drilling fluid through the discharge opening, the bowl assembly comprising:

an outer bowl having an upper end and a lower end, the bowl opening extending through the outer bowl intersecting the upper and the lower ends of the outer bowl, the outer bowl having a recess formed in the upper end of the outer bowl and extending a distance through the outer bowl toward the lower end of the outer bowl terminating with a lower edge; and a wear insert having an upper end, a lower end, an inner peripheral surface and an outer peripheral surface; and a rotating assembly disposed in the bowl opening comprising:

an elastomeric member having an upper end, a lower end, an elastomeric member outer peripheral surface and a drive opening extending through the elastomeric member intersecting the upper end and the lower end of the elastomeric member; and a rotating bushing connected to the elastomeric member outer peripheral surface, the rotating assembly being disposed in the bowl opening in an operating position wherein the elastomeric member sealingly engages a portion of the inner peripheral surface of the wear insert and the rotating bushing bearingly engages the bowl assembly for rotatingly supporting the rotating assembly in the bowl opening, the drill pipe being extendable through the drive opening in the elastomeric member and the elastomeric member grippingly engaging the drill pipe, and the rotating of the drill pipe causing the rotation of the rotating assembly due to the gripping engagement between the elastomeric member and the drill pipe.

2. The rotating head of claim 1 wherein the rotating bushing is defined further as being cylindrically shaped having an outer peripheral surface, an upper end, a lower end and a bushing opening extending therethrough intersecting the upper end and the lower end of the rotating bushing and forming an inner peripheral surface, a portion of the elastomeric member being disposed in the bushing opening to a position wherein the upper end of the rotating bushing is disposed near the upper end of the elastomeric member and the inner peripheral surface of the rotating bushing is disposed about adjacent the elastomeric member outer peripheral surface and in this position the rotating bushing being secured to the outer peripheral surface of the elastomeric member.

3. The rotating head of claim 2 wherein the rotating bushing is further defined to comprise a recess formed in the inner peripheral surface of the rotating bushing, and wherein the elastomeric member is further defined to comprise a recess flange formed on the outer peripheral surface of the elastomeric member and extending a distance from the outer peripheral surface of the elastomeric member, the recess flange being disposed in the recess formed in the rotating bushing for cooperating to secure the rotating bushing to the elastomeric member.

4. The rotating head of claim 2 wherein the rotating bushing is further defined to comprise at least two recesses, each recess being formed in the inner peripheral surface of the rotating bushing, and wherein the elastomeric member is further defined to comprise at least two recess flanges, each recess flange being formed on the outer peripheral surface of the elastomeric member and each recess flange extending a distance radially from the outer peripheral surface of the elastomeric member, each recess flange being disposed in one of the recess in the rotating bushing for cooperating to secure the rotating bushing to the elastomeric member.

5. The rotating head of claim 2 wherein the elastomeric member is defined further to comprise a cylindrically shaped portion extending from the upper end of the elastomeric member a distance toward the lower end of the elastomeric member terminating with a lower end of the cylindrically shaped portion and having a substantially flat, vertically extending outer peripheral surface forming a portion of the elastomeric outer peripheral surface, the inner peripheral surface of the rotating bushing being disposed about adjacent the flat, vertically extending outer peripheral surface of the cylindrically shaped portion of the elastomeric member.

6. The rotating head of claim 5 wherein the rotating bushing is defined further as being secured to the elastomeric member in a position wherein the lower end of the rotating bushing is disposed near the lower end of the cylindrically shaped portion of the elastomeric member.

7. The rotating head of claim 5 wherein the elastomeric member further comprises a seal flange formed on the elastomeric member having an outer peripheral surface tapered inwardly toward the drive bore in the elastomeric member, the seal flange extending from the lower end of the cylindrically shaped portion of the elastomeric member a distance toward the lower end of the elastomeric member, the outer peripheral surface of the seal flange sealingly engaging a portion of the bowl assembly for forming a seal between the rotating assembly and the bowl assembly, and the outer peripheral surface of the seal flange forming a portion of the elastomeric outer peripheral surface.

8. The rotating head of claim 1 wherein the rotating bushing is defined further as being cylindrically shaped having an outer peripheral surface, an upper end, a lower end and a bushing opening extending therethrough intersecting the upper end and the lower end of the rotating bushing and forming an inner peripheral surface, a portion of the elastomeric member being disposed in the bushing opening to a position wherein the upper end of the rotating bushing is disposed near the upper end of the elastomeric member and the inner peripheral surface of the rotating bushing is disposed about adjacent the elastomeric member outer peripheral surface and in this position the rotating bushing being secured to the outer peripheral surface of the elastomeric member.

9. The rotating head of claim 8 wherein the wear insert is defined further to comprise a bearing surface formed on the inner peripheral surface of the wear insert generally between the upper and the lower end of the wear insert, and wherein the rotating bushing is defined further as comprising a tapered wall formed on the lower end of the rotating bushing forming a lower bearing surface, the lower bearing surface on the rotating bushing bearingly engaging the bearing surface on the wear insert.

10. The rotating head of claim 9 wherein the bowl assembly further comprises:

a clamp housing having an upper surface, a lower surface and an outer peripheral surface, a recess being formed in the lower surface of the clamp housing, the upper end of the rotating assembly being disposed in the recess in the clamp housing, a clamp screw opening being formed through the clamp housing intersecting the outer peripheral surface and extending a distance radially through the clamp housing and intersecting the recess in the clamp housing;

rod means having a first end and a second end disposed in the clamp screw opening;

a bearing plate connected to the second end of the rod means having a beveled edged formed thereon forming a bearing surface; and wherein the rotating bushing is defined further to comprise a tapered wall formed on the upper end of the rotating bushing forming an upper bearing surface, the upper bearing surface on the rotating bushing being bearingly engageable with the bearing surface formed on the bearing plate; and means for moving the rod means in the clamp screw opening to one position wherein the bearing surface on the bearing plate bearingly engages the upper bearing surface on the rotating bushing and for moving the rod means in the clamp screw opening to one other position wherein the bearing surface on the bearing plate is spaced a distance from the upper bearing surface on the rotating bushing, the rod means being movable in the clamp screw opening for adjusting the position of the bearing surface on the bearing plate with respect to the upper bearing surface on the rotating bushing.

11. The rotating head of claim 9 wherein the bowl assembly further comprises:

a clamp housing having an upper surface, a lower surface and an outer peripheral surface, a recess being formed in the lower surface of the clamp housing, the upper end of the rotating assembly being disposed in the recess in the clamp housing, a first clamp screw opening being formed through the clamp housing intersecting the outer peripheral surface and extending a distance radially through the clamp housing and intersecting the recess in the clamp housing, and a second clamp screw opening being formed through the clamp housing intersecting the outer peripheral surface and extending a distance radially through the clamp housing and intersecting the recess in the clamp housing, the first clamp screw opening being spaced a distance from the second clamp screw opening;

a first rod means having a first end and a second end disposed in the first clamp screw opening;

a bearing plate connected to the second end of the first rod means having a beveled edge formed thereon forming a bearing surface; and a second rod means having a first end and a second end disposed in the second clamp screw opening;

a bearing plate connected to the second end of the second rod means having a beveled edge formed thereon forming a bearing surface; and wherein the rotating bushing is defined further to comprise a tapered wall formed on the upper end of the rotating bushing forming an upper bearing surface, the bearing surface on the bearing plate connected to the first rod means and the bearing surface on the bearing plate connected to the second rod means being bearingly engageable with the upper bearing surface formed on the rotating bushing; and means for moving the first rod means in the first clamp screw opening to one position wherein the bearing surface on the bearing plate connected to the first rod means bearingly engages the upper bearing surface on the rotating bushing and for moving the first rod means in the first clamp screw opening to one other position wherein the bearing surface on the bearing plate connected to the first rod means is spaced a distance from the upper bearing surface on the rotating bushing, the first rod means being movable in the clamp screw opening for adjusting the position of the bearing surface on the bearing plate connected to the first rod means with respect to the upper bearing surface on the rotating bushing; and means for moving the second rod means in the second clamp screw opening to one position wherein the bearing surface on the bearing plate connected to the second rod means bearingly engages the upper bearing surface on the rotating bushing and for moving the second rod means in the second clamp opening to one other position wherein the bearing surface on the bearing plate connected to the second rod means is spaced a distance from the upper bearing surface on the rotating bushing, the second rod means being movable in the second clamp screw opening for adjusting the position of the bearing surface on the bearing plate connected to the second rod means with respect to the upper bearing surface on the rotating bushing.

12. An improvement in a rotating assembly adapted for use in a rotating head wherein the rotating head is adapted for use in drilling a well borehole at a well drilling cite wherein drilling fluid is passed into the well borehole and wherein some of the drilling fluid is passed from the well borehole and wherein a rotatable drill pipe extends into the well borehole during the drilling operation, the rotating head comprising a bowl assembly having a bowl opening and a discharge opening, the bowl assembly being adapted to receive drilling fluid into the bowl opening and pass the drilling fluid through the discharge opening the improvement, comprising:

an elastomeric member having an upper end, a lower end, an elastomeric member outer peripheral surface and a drive opening extending through the elastomeric member intersecting the upper end and the lower end of the elastomeric member; and a rotating bushing connected to the elastomeric member outer peripheral surface, the rotating assembly being disposed in the bowl opening in an operating position wherein the elastomeric member sealingly engages the bowl assembly and the rotating bushing bearingly engages the bowl assembly for rotatingly supporting the rotating assembly in the outer bowl opening, the drill pipe being extendable through the drive opening and the elastomeric member grippingly engaging the drill pipe, and the rotating of the drill pipe causing the rotation of the rotating assembly due to the gripping engagement between the elastomeric member and the drill pipe; and wherein the rotating bushing is cylindrically shaped having an outer peripheral surface, an upper end, a lower end and a bushing opening extending therethrough intersecting the upper end and the lower end of the rotating bushing and forming an inner peripheral surface, a portion of the elastomeric member being disposed in the bushing opening to a position wherein the upper end of the rotating bushing is disposed near the upper end of the elastomeric member and the inner peripheral surface of the rotating bushing is disposed about adjacent the elastomeric member outer peripheral surface and in this position the rotating bushing being secured to the outer peripheral surface of the elastomeric member.

13. The rotating assembly of claim 12 wherein the rotating bushing is further defined to comprise a recess formed in the inner peripheral surface of the rotating bushing, and wherein the elastomeric member is further defined to comprise a recess flange formed on the outer peripheral surface of the elastomeric member and extending a distance from the outer peripheral surface of the elastomeric member, the recess flange being disposed in the recess formed in the rotating bushing for cooperating to secure the rotating bushing to the elastomeric member.

14. The rotating assembly of claim 12 wherein the rotating bushing is further defined to comprise at least two recesses, each recess being formed in the inner peripheral surface of the rotating bushing, and wherein the elastomeric member is further defined to comprise at least two recess flanges, each recess flange being formed on the outer peripheral surface of the elastomeric member and each recess flange extending a distance radially from the outer peripheral surface of the elastomeric member, each recess flange being disposed in one of the recess in the rotating bushing for cooperating to secure the rotating bushing to the elastomeric member.

15. The rotating assembly of claim 12 wherein the elastomeric member is defined further to comprise a cylindrically shaped portion extending from the upper end of the elastomeric member a distance toward the lower end of the elastomeric member terminating with a lower end of the cylindrically shaped portion and having a substantially flat, vertically extending outer peripheral surface forming a portion of the elastomeric outer peripheral surface, the inner peripheral surface of the rotating bushing being disposed about adjacent the flat, vertically extending outer peripheral surface of the cylindrically shaped portion of the elastomeric member.

16. The rotating assembly of claim 15 wherein the rotating bushing is defined further as being secured to the elastomeric member in a position wherein the lower end of the rotating bushing is disposed near the lower end of the cylindrically shaped portion of the elastomeric member.

17. The rotating head of claim 15 wherein the elastomeric member further comprises a seal flange formed on the elastomeric member having an outer peripheral surface tapered inwardly toward the drive bore in the elastomeric member, the seal flange extending from the lower end of the cylindrically shaped portion of the elastomeric member a distance toward the lower end of the elastomeric member, the outer peripheral surface of the seal flange sealingly engaging a portion of the bowl assembly for forming a seal between the rotating assembly and the bowl assembly, and the outer peripheral surface of the seal flange forming a portion of the elastomeric outer peripheral surface.

18. The rotating assembly of claim 12 wherein the bowl assembly further comprises an outer bowl having an upper end and a lower end, the bowl opening extending through the outer bowl intersecting the upper and the lower ends of the outer bowl, and wherein the improvement further comprises:

a recess formed in the upper end of the outer bowl and extending a distance through the outer bowl toward the lower end of the outer bowl terminating with a lower edge; and a wear insert having an upper end, a lower end, an inner peripheral surface and an outer peripheral surface, a portion of the inner peripheral surface of the wear insert sealingly engaging a portion of the elastomeric member.

19. The rotating head of claim 18 wherein the rotating bushing is defined further as being cylindrically shaped having an outer peripheral surface, an upper end, a lower end and a bushing opening extending therethrough intersecting the upper end and the lower end of the rotating bushing and forming an inner peripheral surface, a portion of the elastomeric member being disposed in the bushing opening to a position wherein the upper end of the rotating bushing is disposed near the upper end of the elastomeric member and the inner peripheral surface of the rotating bushing is disposed about adjacent the elastomeric member outer peripheral surface and in this position the rotating bushing being secured to the outer peripheral surface of the elastomeric member.

20. The rotating head of claim 19 wherein the wear insert is defined further to comprise a bearing surface formed on the inner peripheral surface of the wear insert generally between the upper and the lower end of the wear insert, and wherein the rotating bushing is defined further as comprising a tapered wall formed on the lower end of the rotating bushing forming a lower bearing surface, the lower bearing surface on the rotating bushing bearingly engaging the bearing surface on the wear insert.

21. The rotating head of claim 20 further comprising:

a clamp housing having an upper surface, a lower surface and an outer peripheral surface, a recess being formed in the lower surface of the clamp housing, the upper end of the rotating assembly being disposed in the recess in the clamp housing, a clamp screw opening being formed through the clamp housing intersecting the outer peripheral surface and extending a distance radially through the clamp housing and intersecting the recess in the clamp housing;

rod means having a first end and a second end disposed in the clamp screw opening;

a bearing plate connected to the second end of the rod means having a beveled edged formed thereon forming a bearing surface; and wherein the rotating bushing is defined further to comprise a tapered wall formed on the upper end of the rotating bushing forming an upper bearing surface, the upper bearing surface on the rotating bushing being bearingly engageable with the bearing surface formed on the rod means; and means for moving the rod means in the clamp screw opening to one position wherein the bearing surface on the bearing plate bearingly engages the upper bearing surface on the rotating bushing and for moving the rod means in the clamp screw opening to one other position wherein the bearing surface on the bearing plate is spaced a distance from the upper bearing surface on the rotating bushing, the rod means being movable in the clamp screw opening for adjusting the position of the bearing surface on the bearing plate with respect to the upper bearing surface on the rotating bushing.

22. The rotating head of claim 20 wherein the improvement further comprises:

a clamp housing having an upper surface, a lower surface and an outer peripheral surface, a recess being formed in the lower surface of the clamp housing, the upper end of the rotating assembly being disposed in the recess in the clamp housing, a first clamp screw opening being formed through the clamp housing intersecting the outer peripheral surface and extending a distance radially through the clamp housing and intersecting the recess in the clamp housing, and a second clamp screw opening being formed through the clamp housing intersecting the outer peripheral surface and extending a distance radially through the clamp housing and intersecting the recess in the clamp housing, the first clamp screw opening being spaced a distance from the second clamp screw opening;

a first rod means having a first end and a second end disposed in the first clamp screw opening;

a bearing plate connected to the second end of the first rod means having a beveled edge formed thereon forming a bearing surface; and a second rod means having a first end and a second end disposed in the second clamp screw opening;

a bearing plate connected to the second end of the second rod means having a beveled edge being formed thereon forming a bearing surface; and wherein the rotating bushing is defined further to comprise a tapered wall formed on the upper end of the rotating bushing forming an upper bearing surface, the bearing surface on the first rod means and the bearing surface on the second rod means being bearingly engageable with the upper bearing surface formed on the rotating bushing; and means for moving the first rod means in the first clamp screw opening to one position wherein the bearing surface on the bearing plate connected to the first rod means bearingly engages the upper bearing surface on the rotating bushing and for moving the first rod means in the first clamp screw opening to one other position wherein the bearing surface on the bearing plate connected to the first rod means is spaced a distance from the upper bearing surface on the rotating bushing, the first rod means being movable in the clamp screw opening for adjusting the position of the bearing surface on the bearing plate connected to the first rod means with respect to the upper bearing surface on the rotating bushing; and means for moving the second rod means in the second clamp screw opening to one position wherein the bearing surface on the bearing plate connected to the second rod means bearingly engages the upper bearing surface on the rotating bushing and for moving the second rod means in the second clamp opening to one other position wherein the bearing surface on the bearing plate connected to the second rod means is spaced a distance from the upper bearing surface on the rotating bushing, the second rod means being movable in the second clamp screw opening for adjusting the position of the bearing surface on the bearing plate connected to the second rod means with respect to the upper bearing surface on the rotating bushing.

23. A rotating head adapted for use in drilling a well borehole at a well drilling site wherein drilling fluid is passed into the well borehole and wherein some of the drilling fluid is passed from the well borehole and wherein a rotatable drill pipe extends into the well borehole during the drilling operation, comprising:

a bowl assembly having a bowl opening and a discharge opening, the bowl assembly being adapted to receive drilling fluid into the bowl opening and pass the drilling fluid through the discharge opening, comprising:

an outer bowl having an upper end and a lower end, the bowl opening extending through the outer bowl intersecting the upper end and the lower ends of the outer bowl, a recess forming the upper end of the outer bowl and extending a distance through the outer bowl toward the lower end of the outer bowl terminating with a lower edge; and a wear insert having an upper end, a lower end, an inner peripheral surface and an outer peripheral surface;

a rotating assembly disposed in the bowl opening, comprising:

an elastomeric member having an upper end, a lower end, an elastomeric member outer peripheral surface and a drive opening extending through the elastomeric member intersecting the upper end and the lower end of the elastomeric member, the elastomeric member having a cylindrically shaped portion extending from the upper end of the elastomeric member, wherein the elastomeric member is defined further to comprise a cylindrically shaped portion extending from the upper end of the elastomeric member a distance toward the lower end of the elastomeric member terminating with a lower end of the cylindrically shaped portion and having a substantially flat, vertically extending outer peripheral surface forming a portion of the elastomeric outer peripheral surface, a seal flange being formed on the elastomeric member having an outer peripheral surface the outer peripheral surface of the seal flange sealingly engaging a portion of the wear insert;

a cylindrically shaped, rotating bushing having an outer peripheral surface, an upper end, a lower end and a bushing opening extending therethrough intersecting the upper end and the lower end of the rotating bushing and forming an inner peripheral surface, a portion of the elastomeric member being disposed in the bushing opening to a position wherein the upper end of the rotating bushing is disposed near the upper end of the elastomeric member and the inner peripheral surface of the rotating bushing is disposed about adjacent the elastomeric member outer peripheral surface and in this position the rotating bushing being secured to the outer peripheral surface of the elastomeric member, the rotating bushing being secured to the elastomeric member in a position wherein the lower end of the rotating bushing is disposed near the lower end of the cylindrically shaped portion of the elastomeric member; and a clamp housing having an upper surface, a lower surface and an outer peripheral surface, a recess being formed in the lower surface of the clamp housing, the upper end of the rotating assembly being disposed in the recess in the clamp housing, a clamp screw opening being formed through the clamp housing intersecting the outer peripheral surface and extending a distance radially through the clamp housing and intersecting the recess in the clamp housing;

rod means having a first end and a second end disposed in the clamp screw opening;

a bearing plate connected to the second end of the rod means having a beveled edged formed thereon forming a bearing surface; and wherein the rotating bushing is defined further to comprise a tapered wall formed on the upper end of the rotating bushing forming an upper bearing surface, the upper bearing surface on the rotating bushing being bearingly engageable with the bearing surface formed on the bearing plate; and means for moving the rod means in the clamp screw opening to one position wherein the bearing surface o the bearing plate bearingly engages the upper bearing surface on the rotating bushing and for moving the rod means in the clamp screw opening to one other position wherein the bearing surface on the bearing plate is spaced a distance from the upper bearing surface on the rotating bushing, the rod means being movable in the clamp screw opening for adjusting the position of the bearing surface on the bearing plate with means to the upper bearing surface on the rotating bushing; and wherein the rotating bushing is defined further to comprise a taper wall formed on the lower end of the rotating bushing forming a lower bearing surface, and wherein the wear plate further peripheral surface of the wear plate bearingly engaging the lower bearing surface on the rotating bushing.

* * * * *

UNITED STATES PATENT AND TRADEMARK OFFICE

CERTIFICATE OF CORRECTION

PATENT NO. : 5,137,084

DATED : August 11, 1992

INVENTOR(S) : Don E. Gonzales, Robert M. Bearden

It is certified that error appears in the above-identified patent and that said Letters Patent is hereby corrected as shown below:

Column 7, line 6, please delete the word "ad" and substitute therefore the word --and--.

Column 16, line 36, please delete the word "o" and substitute therefore the word --on--.

Column 16, line 50, after the word "further", please insert --comprises a bearing surface formed on the inner--.

Signed and Sealed this

Twentieth Day of September, 1994

Bruce Lehman

*Attest:*

BRUCE LEHMAN

*Attesting Officer*

*Commissioner of Patents and Trademarks*